United States Patent [19]

Lintelmann et al.

[11] 4,185,278

[45] Jan. 22, 1980

[54] OBSCURATION TYPE SMOKE DETECTOR

[75] Inventors: Willy Lintelmann, Old Saybrook; Peter J. Frey, West Hartford, both of Conn.

[73] Assignee: HF Systems, Incorporated, Wolcott, Conn.

[21] Appl. No.: 835,449

[22] Filed: Sep. 22, 1977

[51] Int. Cl.[2] ..... G08B 17/10

[52] U.S. Cl. ..... 340/630; 250/575; 356/438

[58] Field of Search ..... 340/237 S, 630; 250/573, 575, 574, 212; 356/207, 438, 439

[56] References Cited

U.S. PATENT DOCUMENTS

| | | | |
|---|---|---|---|
| 2,298,757 | 10/1942 | Evans et al. | 340/237 S |
| 2,763,853 | 9/1956 | Grant, Jr. | 340/237 S |
| 3,198,935 | 8/1965 | Floyd | 250/212 X |
| 3,222,661 | 12/1965 | Vasel et al. | 340/237.5 X |
| 3,255,441 | 6/1966 | Goodwin et al. | 340/237.5 X |
| 3,409,885 | 11/1968 | Hall | 356/207 |
| 3,473,036 | 10/1968 | Marcus | 250/212 X |
| 3,919,546 | 11/1975 | Lutus | 250/212 X |
| 3,954,342 | 5/1976 | Boeke | 356/207 X |
| 4,021,792 | 5/1977 | Ludt et al. | 340/237.5 |
| 4,053,785 | 10/1977 | Lee et al. | 250/574 |

*Primary Examiner*—John W. Caldwell, Sr.
*Assistant Examiner*—Daniel Myer

[57] ABSTRACT

Miniaturized smoke detectors, which operate on a light obscuration principle and may be either AC or battery operated, are both optically and electrically balanced whereby an unbalance resulting from the presence of smoke will trigger an alarm. The smoke detectors are characterized by a smoke chamber in which a light emitting diode and a pair of light detectors are installed in a manner which precludes relative movement therebetween. A splitter plate is also installed in the smoke chamber whereby both detectors are caused to see the same light flux density and one of the detectors, positioned in close physical proximity to the light source, acts as a reference signal source.

15 Claims, 6 Drawing Figures

ALARM
ZD 3
R56
D7
C8
14
R52
ZD-2
Q12
C7
Q14
ZD-1
D5
SCR-1
R50
C9
R46
D6
R48
Q10
C6
R44
10
Q2
PD-2
Q1
LED-1
PD-1
18
Q9
R1
R54
R30
R40
R38
Q8
R42
C5
Q7
R34
R36
D3
D4
SW-2
16
R32

OBSCURATION TYPE SMOKE DETECTOR

BACKGROUND OF THE INVENTION (1) Field of the Invention

The present invention is directed to providing a warning of the existence of an unsafe condition in an area under surveillance and particularly to the detection of the presence of smoke before the smoke's density reaches a dangerous level. More specifically, this invention is directed to a condition responsive device for providing an alarm in response to smoke density in excess of a predetermined level. Accordingly, the general objects of the present invention are to provide novel and improved methods and apparatus of such character.

(2) Description of the Prior Art

While not limited thereto in its utility, the present invention is particularly well suited for use in or as a fire alarm system. Accordingly, the invention will be described below in the context of such a system and particularly with respect to an alarm which is responsive to smoke density.

As is well known, most fatalities suffered in fires result from smoke inhalation. As is also well known, in most fatal home fires the smoke density reaches a level which is sufficiently high to incapacitate the victims before there has been adequate temperature rise to cause activation of a conventional temperature sensitive alarm system located a significant distance from the fire.

Present commercially available smoke detectors suitable for residential use may be divided into two general types based upon their principle of operation. The first general type includes those devices which utilize an ionization principle while the second type includes those devices which operate on a photoelectric refraction or light scatter principle. Ionization type smoke detectors are overly susceptible to false alarm and are insensitive to deadly cold smoke. With regard to false alarm, ionization type detectors may be false triggered by hair or deodorant spray, atmospheric changes or harmless effluent from cooking. The susceptibility to false alarm and the insensitivity to cold smoke, plus severe location restrictions, characteristic of ionization type smoke detectors have slowed the trend toward needed fire safety legislation and public acceptance. In the case of photoelectric light scatter devices, because of their rather restricted air inlets, response to the presence of smoke is relatively slow. More importantly, the sensitivity of devices which operate on a refraction principle varies with the aging of the light source, which is typically a short-lived incandescent lamp, and with different colors of smoke. In practice, the sensitivity of available smoke detectors operating on a photoelectric refraction principle will vary with the individual light source employed and it may be noted that the light emitted by lamps of the same type will vary within a predetermined tolerance range. As an additional disadvantage, photoelectric light scatter devices are, because of a characteristic high power consumption, limited to AC operation.

To be safe and acceptable, a smoke detector must not be sensitive to supply voltage, temperature, component aging or dirty optics since any of these factors could cause a false alarm or, more importantly, an increase in the smoke density at which the device will alarm. Similarly, a smoke detector must be insensitive to atmospheric shock. Further, a usable smoke detector should preferably include means to advise the user of a component failure, particularly a light source failure in the case of an optical device. Optical type devices should also be immune to false triggering by external light. All prior art smoke detectors have failed to meet one, and usually several, of these criteria.

A third known technique for the detection of the presence of smoke may generally be described as light obscuration. It has long been known that the most straightforward and accurate manner of detecting the presence of smoke is to measure the obscuration of a detector resulting from the presence of smoke between the detector and a light source. Large instruments operating on the light obscuration principle are employed in testing laboratories as the standard against which ionization and light scatter devices are rated. However, partly as a consequence of the large size and comparatively high cost of previously available obscuration type smoke detectors, devices operating on an obscuration principle have not been available for the general residential market.

SUMMARY OF THE INVENTION

The present invention overcomes the above briefly discussed and other deficiencies and disadvantages of the prior art by providing a novel and improved smoke detector which operates on the obscuration principle. Condition responsive alarm devices in accordance with the present invention are characterized by extremely low power requirements whereby they may be either AC or battery powered. Devices in accordance with the present invention are further characterized by small size, modest cost, a high degree of sensitivity to smoke of any color or temperature, a degree of stability which is unmatched by even expensive laboratory instruments and an insensitivity to those factors which have caused false triggering of prior smoke detection devices.

In accordance with a preferred embodiment of the invention an obscuration type smoke detector includes means defining a smoke chamber, said chamber defining means being provided with a plurality of spaced apertures for admitting smoke thereto. A light emitting diode is mounted so as to emit light into the smoke chamber. A first light detector including a photo diode is positioned to directly receive light emitted by the light emitting diode and transmitted across the smoke chamber whereby the intensity of the light incident upon the first light detector will be a function of the density of the smoke in the chamber. A reference signal generator including a second photo diode is positioned such that light emitted into the smoke chamber by said light emitting diode will be incident thereon. The detector further includes a comparator connected to receive as inputs the signals generated by said photo diodes. The comparator provides an alarm energization signal when the difference between the input signals thereto are indicative of a predetermined smoke density.

A smoke detector in accordance with the present invention is characterized by the light emitting diode and the photo diodes each being mounted within a housing and said housings being bonded to said smoke chamber defining means whereby relative movement between the diodes is precluded. The smoke chamber defining means preferably comprises a tubular member having a pair of oppositely disposed axially aligned open ends which respectively receive the light emitting diode and the first photo diode. This tubular member has an off-axis opening for receiving the second photo diode and the inside of the tubular member is characterized by minimal reflectance.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 1:
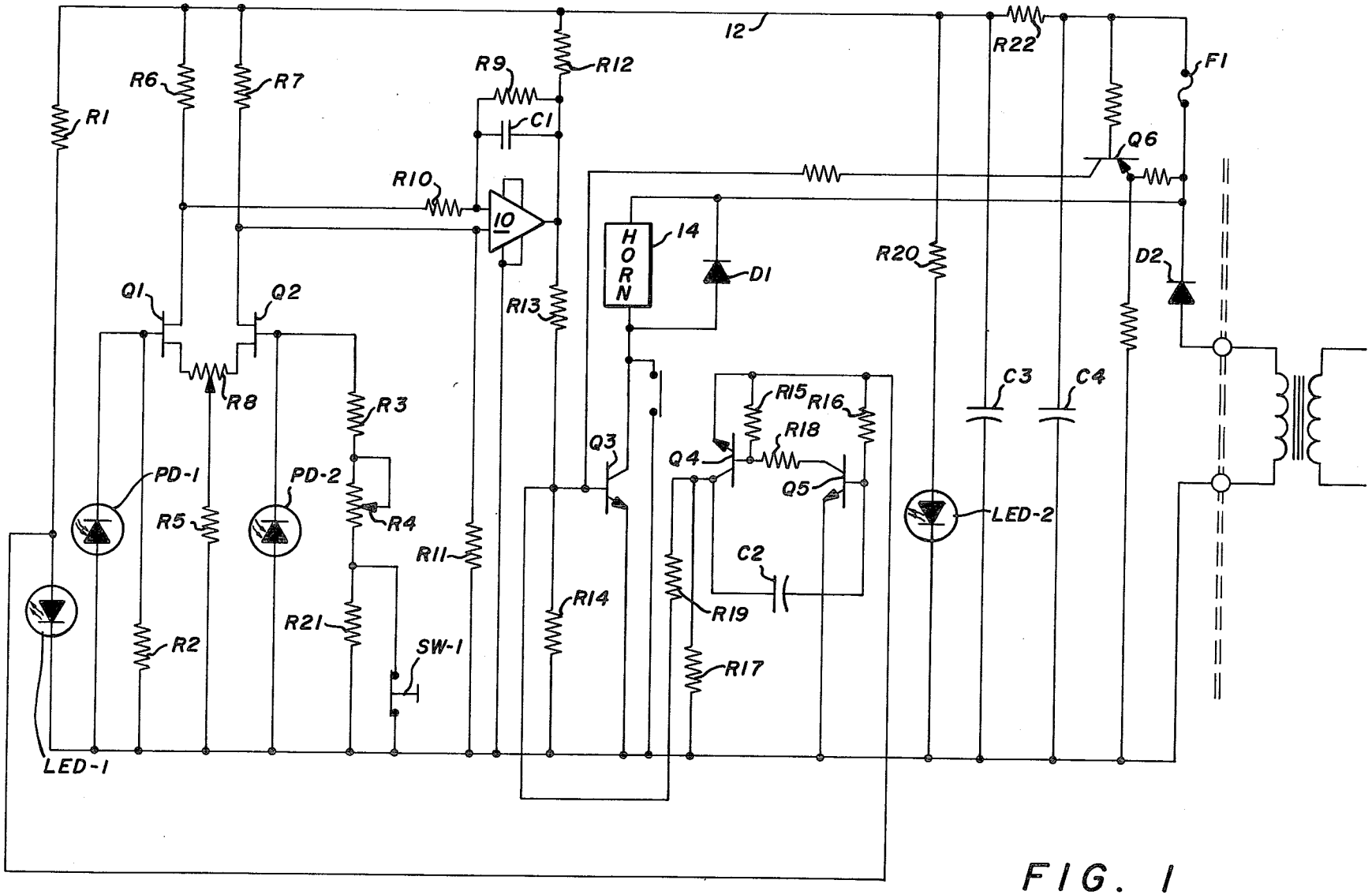
FIG. 1 is an electrical schematic diagram of a first embodiment of the present invention which employs discrete components and which is alternating current powered.

With reference first to FIG. 1, an alternating current powered obscuration type smoke detector in accordance with a first embodiment of the present invention is shown schematically. The smoke detector employs a pair of optically and electrically balanced photo diodes PD-1 and PD-2. As will become apparent from the description of FIG. 5, photo diodes PD-1 and PD-2 are mounted in a tubular smoke chamber, thereinafter referred to as the optical tube, in such a manner that relative motion therebetween is precluded. The photo diodes PD-1 and PD-2 are positioned such that both receive the same light flux density from a light emitting diode LED-1; a splitter plate being employed for the purpose of dividing the light emitted by diode LED-1.

It is believed the present invention may best be understood from an operational description thereof. Photo diodes PD-1 and PD-2 are used in the photo voltaic mode wherein each diode generates its own voltage when light is impressed upon its junction. A photo voltaic mode of operation renders the device substantially insensitive to atmospheric shock, such as changes in temperature and humidity, through connection of the detectors in a low impedance circuit. Restated, PD-1 and PD-2 function as reference voltage sources and thus effectively act as Zener diodes. As noted above, the light generated by LED-1 is transmitted down the length of the optical tube to detector diode PD-1 and, via a splitter plate, to reference photo diode PD-2. As also noted above, the diodes are positioned, i.e., the distances are set; so that both photo diodes see approximately the same light flux density. A resistor R2 functions as the load on photo diode PD-1 whereas series connected resistor R3 and potentiometer R4 serve as the load on photo diode PD-2. The load resistors determine mine the sensitivity to changes in light flux density of the photo diodes and additionally provide gate bias for a pair of matched field effect transistors Q1 and Q2 which are connected as a differential amplifier. Potentiometer R4 is employed to adjust the voltage across photo diode PD-2 so as to make this voltage identical to the voltage across photo diode PD-1.

The voltages produced by photo diodes PD-1 and PD-2 are delivered to the gates of respective FET's Q1 and Q2. A resistor R5 sets the bias point of both FET's and, in cooperation with load resistors R6 and R7, operates each FET at the zero TC point. A potentiometer R8 balances the differential amplifier, comprising FET's Q1 and Q2, for "zero" offset across the FET load resistors R6 and R7 when light emitting diode LED-1 is in the off condition. Resistor R8 thus enables balancing out of any differences in the FET's and differences in the leakage currents in the photo diodes.

With light emitting diode LED-1 in the on condition and resistor R4 adjusted for equal voltage at both FET gates, there will be no voltage offset present at the output of the differential amplifier. Accordingly, supply voltage, LED light flux density and temperature may vary without affecting the "zero" offset voltage at the output of the differential amplifier when both photo diodes are seeing the same light flux density as is indicative of a lack of obscuration of photo diode PD-1 by the presence of smoke; photo diode PD-2 functioning as a reference voltage source. The present invention thus comprises a true compensated balancing system wherein the device tracks from zero to full output of the LED and the need for voltage regulation and LED temperature compensation is eliminated. When obscuration occurs in the smoke detection area of the smoke chamber, the light flux density seen by photo diode PD-1 is reduced relative to that seen by photo diode PD-2. Thus, an offset voltage will be generated and will appear across the load resistors R6 and R7 of the differential amplifier.

The output voltages provided by the differential amplifier; i.e., the outputs of FET's Q1 and Q2; which function as variable resistors are delivered to the inputs of an operational amplifier connected as a high gain voltage comparator 10. Voltage comparator 10 is provided with a feedback system or hysterisis loop comprising resistors R9 and R10. The hysterisis loop is "set" to a preselected level, for example 50 mv, whereby the output of voltage comparator 10 is prevented from switching until a signal in excess of the set voltage appears across its inputs. Typically, voltage comparator 10 will have a "low" output state as defined by the fact that output transistor in comparator 10 will be normally conductive. Once the "set" input voltage differential has been exceeded, as a result of smoke obscuration of photo diode PD-1, the ouput of comparator 10 will "snap" to the "high" state wherein the output transistor in comparator 10 is rendered nonconductive. Thus, under no smoke conditions, the output of comparator 10 is low and a current path from the power bus 12 to ground is established via pull-up resistor R12 and the internal output transistor of comparator 10. When obscuration takes place and the hysterisis voltage is exceeded, the internal output transistor of comparator 10 is turned off and there will be an increased current flow through pull-up resistor R12 and the voltage divider network comprising resistors R13 and R14. Since the junction between resistors R13 and R14 is connected to the base of a normally nonconductive transistor Q3, increased current flow through voltage divider R13, R14 will result in the base voltage of Q3 rising and transistor Q3 being turned on. When transistor Q3 becomes conductive, a first terminal of a horn or other audible warning device 14 will be grounded and current will flow to ground through the alarm device which will thus be energized. The use of an operational amplifier with a hysterisis loop eliminates the need for a calibration control to adjust the sensitivity of the device.

To shut off alarm device 14 when photo diodes PD-1 and PD-2 again see the same light flux density, horn transients are delivered to the input of comparator 10 via capacitor C1 thus reversing the hysterisis process and resetting the output of comparator 10 "low". The diode D1 is connected in parallel with alarm device 14 to suppress spikes and thus protect transistor Q3.

Should light emitting diode LED-1 fail, the smoke detector will, of course, be unable to detect smoke and will thus be rendered inoperative. It is desirable to provide a warning that the unit has failed. Light emitting diodes most commonly fail in the open mode and if LED-1 should open the voltage at the junction of current limiting resistor R1 and diode LED-1 is connected to a negative resistance relaxation oscillator comprising transistors Q4 and Q5. Should LED-1 fail in the open mode, there will be an increase in the voltage applied to the junction of resistors R15 and R16 in the relaxation oscillator circuit. Accordingly, power will be applied to the relaxation oscillator. Initially, capacitor C2 acts as a short circuit to ground through resistor R17 and transistor Q5 is maintained in the nonconductive state. At this time the voltage applied to the base of transistor Q4 is "high", because of the action of biasing resistor R15, and the collector of transistor Q5 is thus "low". As capacitor C2 charges through resistors R16 and R17, the voltage at the base of transistor Q4 will rise and when the $V_{BE}$ saturation point is reached, transistor Q5 will turn on and will conduct through resistors R15 and R18. Conduction of transistor Q5 lowers the bias applied to the base of transistor Q4 thereby turning on transistor Q4 and setting its collector "high". This "high" collector voltage of transistor Q4 is, via a current limiting resistor R19, applied to the base of transistor Q3 thereby turn on Q3 and energize alarm device 14. The conduction of transistor Q4 also establishes a discharge path for capacitor C2. Capacitor C2 will continue to discharge until the cutoff point for transistor Q5 is reached. Transistor Q5 will thus shut off and will turn off transistors Q3 and Q4. The action of the relaxation oscillator is repetitive and thus the alarm device 14 will be intermittently energized.

The embodiment of FIG. 1 of the invention also includes a pilot light in the form of a second light emitting diode LED-2. Diode LED-2 is connected in series with a current limiting resistor R20 and provides an indication that power is present within the device.

The embodiment of FIG. 1 may also include a electronically simulated smoke test which enables the user to ensure that the apparatus is operational and particularly that its sensitivity has not diminished over the preset value which may, for example, be 2% smoke density. The simulated smoke test is accomplished through the use of a normally closed switch SW1 which is connected in series with the calibration control comprising series connected resistor R3 and potentiometer R4. A further resistor R21 is connected in parallel with switch SW1. When switch SW1 is opened, through depression of a "TEST" button, resistor R21 will be inserted in series with the calibration control thus imposing a higher gate voltage on FET Q2. The value of resistor R21 is selected such that its insertion in the circuit will, for example, result in a 100 mv offset between load resistors R6 and R7 whereby the alarm 14 will be energized in the manner described above. The value of resistor R1 will typically be selected to represent a smoke density twice that to which the detector device has been set. For example, if the device is set to alarm at 2% smoke density, operation of switch SW1 will simulate 4% sensitivity. Switch SW1 is spring loaded whereby release of its actuator button will result in the alarm being de-energized.

The power supply for the alternating current powered smoke detector device of FIG. 1 is a basic half wave rectifier system with a capacitor pie filter. The power supply is defined by diode D2, resistor R22 and capacitors C3 and C4. The power supply may include a power failure alarm which warns the user of a power supply failure or a short circuit within the detector device. The power failure alarm will thus prevent damage to the smoke detector in the case of a power supply failure or system short. If there is a short circuit, for example if either of filter capacitors C3 or C4 fail or if there is a short circuit in the load comprising the smoke detector circuit, a fuse F1 will open. Opening of fuse F1, with a short circuit in the power supply or detector system, will set the base of a transistor Q6 to ground whereby the transistor will begin conducting. When transistor Q6 begins to conduct, its collector voltage will rise whereby the base of transistor Q3 will go "high" and Q3 will be turned on thus energizing audible alarm 14. Since fuse F1 will be opened, under these failure conditions unfiltered direct current will be applied to the alarm device resulting in an audibly different warning than is percieved under normal operating conditions.

It is to be noted that the circuitry of the above-described alternating current powered embodiment of the present invention may be somewhat simplified through the use of a first silicon controlled rectifier in place of alarm energizing transistor Q3 and a second silicon controlled rectifier to perform the function of the relaxation oscillator comprising rransistors Q4 and Q5. Further, the number of components in the power supply may be reduced by replacing the pie filter with a parallel connected Zener diode and electrolytic filter capacitor. As will be described in the discussion of FIG. 5 below, the electronically simulated smoke test may be eliminated in favor of a mechanical test wherein the light path between diode LED-1 and photodetector PD-1 is partially and temporarily obstructed.

Figure 2:
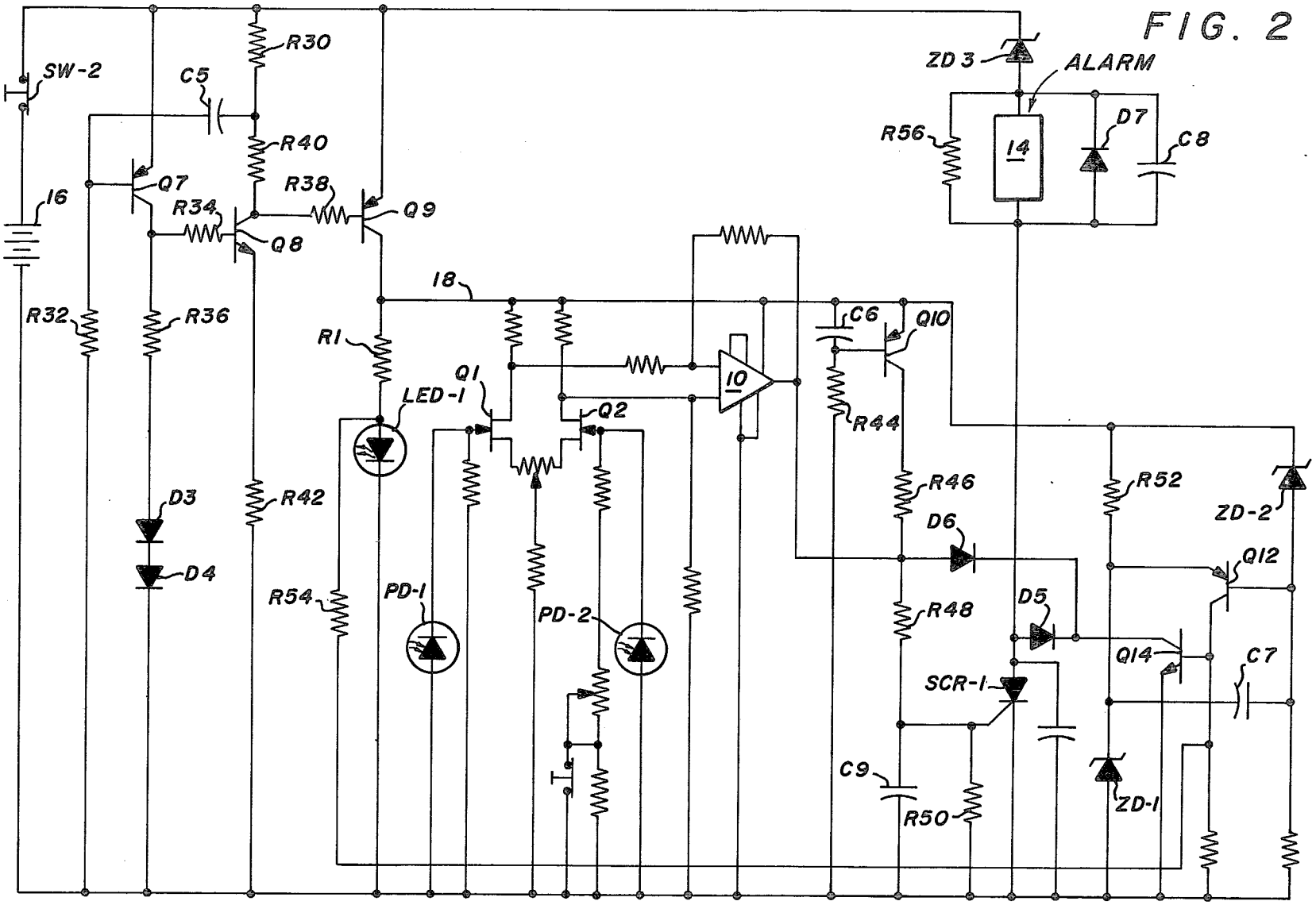
FIG. 2 is an electrical schematic diagram of a second embodiment of the present invention which employs discrete components and is direct current powered.

Referring now to FIG. 2, a battery powered embodiment of the smoke detector of the present invention is shown schematically. The principle difference between the embodiments of FIGS. 1 and 2 is that in the FIG. 2 embodiment, to enhance battery life, the smoke detector system is strobed on and off at a predetermined ratio such as, for example, 20 seconds off verses 20 milliseconds on. This mode of operation is accomplished through the use of a negative resistance relaxation oscillator and drive/isolator transistor. Thus, when power is applied, for example by insertion of a battery 16, capacitor C5 acts as a short circuit via resistors R30 and R32 to hold transistor Q7 of the oscillator in the non-conductible state. With transistor Q7 non-conductive, the base of transistor Q8 of the oscillator is connected to ground through resistors R34 and R36 and diodes D3 and D4. Transistor Q8 is thus maintained in the nonconductive state with its collector "high". The collector of transistor Q8 of the relaxation oscillator is connected, via resistor 38, to the base of isolation transistor Q9 and thus with transistor Q8 in the non-conductive state, transistor Q9 will also be biased off; i.e., the collector voltage of transistor Q9 will be at a level which will, insofar as the smoke detector circuit is concerned, represent an apparent lack of power on power bus 18.

As capacitor C5 charges through resistors R30 and R32, voltage at the junction of capacitor C5 and resistor R32 will lower. When the $V_B$ saturation point of transistor Q7 is reached, the semiconductor will begin conducting through resistor R36 whereupon the base of transistor Q8 will go "high" thus causing transistor Q8 to conduct. Conduction of transistor Q8 causes its collector voltage to drop thereby "setting" the bias on transistor Q9 and turning on transistor Q9. Conduction of transistor Q9 applies power to bus 18 and thus enables the smoke detector circuit comprising LED-1, photodetectors PD-1 and PD-2 and FET's Q1 and Q2. The conduction of transistor Q8 establishes a discharge path for capacitor C5 and this capacitor thus discharges through resistors R40 and R42 until, at a low critical value, transistor Q7 will be shut off thereby causing transistors Q8 and Q9 to also cut off. This action is repetitive and establishes the time base. Resistor R42 functions as a feedback resistor for transistor Q8 which insure a repetitive time base with varying Q8 parameters. By setting the negative side of capacitor C5 to a voltage divider network, the time base of the relaxation oscillator is stabilized for varying voltages. The diodes D3 and D4 forward bias transistor Q8, in conjunction with resistor R42, for proper turn-on and a proper time base with varying temperatures.

The smoke detector circuitry including LED-1, photodetectors PD-1 and PD-2, the differential amplifier comprising FET's Q1 and Q2 and comparator 10 is substantially identical to that described above in connection with FIG. 1 and thus will not be further discussed herein. It is, however, to be noted that in the embodiment of FIG. 2 the capacitor in parallel with comparator 10 may be eliminated.

The embodiment of FIG. 2 also includes a secondary timer which keeps power off the output circuit of comparator 10 during the first 5 milli-seconds of "on time" of the pulsed power bus 18. This action will eliminate any turn-on transients generated by LED-1, PD-1 and PD-2 and the FET's; these transients having the capability of potentially appearing at the output of comparator 10 and energizing the alarm circuit. This secondary timer includes a capacitor C6 which functions as a short circuit to hold a transistor Q10 in the non-conductive state upon application of power to bus 18. With transistor Q10 off, all points in its collector circuit, including the gate of a silicon controlled recitifier SCR-1 connected in series with the audible alarm 14, are held at a low voltage. As capacitor C6 charges through resistor R44, the base voltage of transistor Q10 will lower to the point where this semiconductor will begin conducting. Once turned on, transistor Q10 will remain conductive until the voltage on the pulsed power bus 18 is removed whereupon capacitor C6 will discharge until receipt of the next power pulse.

Under no smoke conditions the output of comparator 10 is low and a current path is established from the power bus 18 to ground through transistor Q10, pull-up resistor R46 and the internal output transistor of comparator 10. At this time the internal output transistor of comparator 10 functions as a short circuit across a voltage divider comprised of resistors R48 and R50. When obscuration takes place and the hysterisis voltage of comparator 10 is exceeded, the internal output transistor of comparator 10 will be turned off thus resulting in current flow through transistor Q10, pull-up resistor R46 and voltage divider R48, R50. When the voltage at the junction of resistors R48 and R50 rises, SCR-1 will be turned on thus grounding one side of the alarm device 14 and energizing the alarm. Because of the latching characteristics of the silicon controlled recitifier, the alarm will continue to sound until power is removed through opening a reset switch SW-2 in series with battery 16.

It may be considered desirable to incorporate a low voltage indicator in battery operated embodiments of the present invention. In the FIG. 2 embodiment low voltage detection is accomplished through the use of a referenced voltage comparator which samples the battery from the pulsed power bus 18. The low voltage detector includes a pair of Zener diodes ZD1 and ZD2. The junction of a resistor R52 and Zener diode ZD1 sets a reference voltage for the emitter of the transistor Q12. This reference voltage is maintained through the action of diode ZD2. The junction between R52 and diode ZD2 will vary directly with the voltage on bus 18 and when this voltage drops more than 16 volts below the voltage applied to the emitter of transistor Q12, the transistor will be turned on. Conduction of transistor Q12 will turn on a further transistor Q14. Conduction of transistor Q14 will ground the alarm device 14 via a diode D5. Since the power to the circuit is pulsed, the alarm device 14 will be energized only during those intervals when power is applied to bus 18. Thus, the alarm will "chirp" to provide a low voltage warning whereas it will be sounded continuously in the case of the detection of smoke. A further capacitor C7 maintains equal voltages on the emitter and base of transistor Q12 during turn-on time to prevent false low voltage warnings resulting from transients or slow turn-on times for the application of power to bus 18.

As in the embodiment of FIG. 1, the battery powered embodiment of FIG. 2 includes a lamp failure alarm. Should LED-1 fail in the open mode, as would be the customary failure, the voltage at the junction between current limiting resistor R1 and resistor R54 will rise. Since R54 is connected to the base of transistor Q14, failure of LED-1 will "pull-up" the base of Q14 turning this transistor on and grounding the alarm device 14. Since power to the LED is pulsed, the lamp failure alarm will consist of "chirping" similar to that experienced during the low voltage alarm condition.

The audible warning device 14 is typically a horn and, during low voltage alarming, transients are generated by the periodic delivery of current through the coil of the horn. These transients are detected and amplified by FET's Q1 and Q2 and could result in a signal appearing at the output of comparator 10 which would cause SCR-1 to latch. To prevent gating of SCR-1 during low voltage alarming, the output of comparator 10 is grounded through diode D6 and transistor Q14.

The circuit for the alarm device 14 includes a Zener diode ZD3 which functions as a voltage regulator to limit voltage to the horn and eliminate spikes to the main power line. A resistor R56 provides holding current to SCR-1 during open contacts within the horn. This prevents the SCR from unlatching during alarm. Capacitor C8 provides for suppression of voltage spikes resulting from internal arcing in horn 14. Diode D7 functions as a negative spike eliminator to prevent destruction of SCR-1 and to prevent the negative anode to cathode voltage limits of the SCR from being exceeded. Capacitor C9 is used to "beat" the propagation delay of diode D6 so that during the "chirping" of the horn SCR-1 will not latch.

Figure 3:
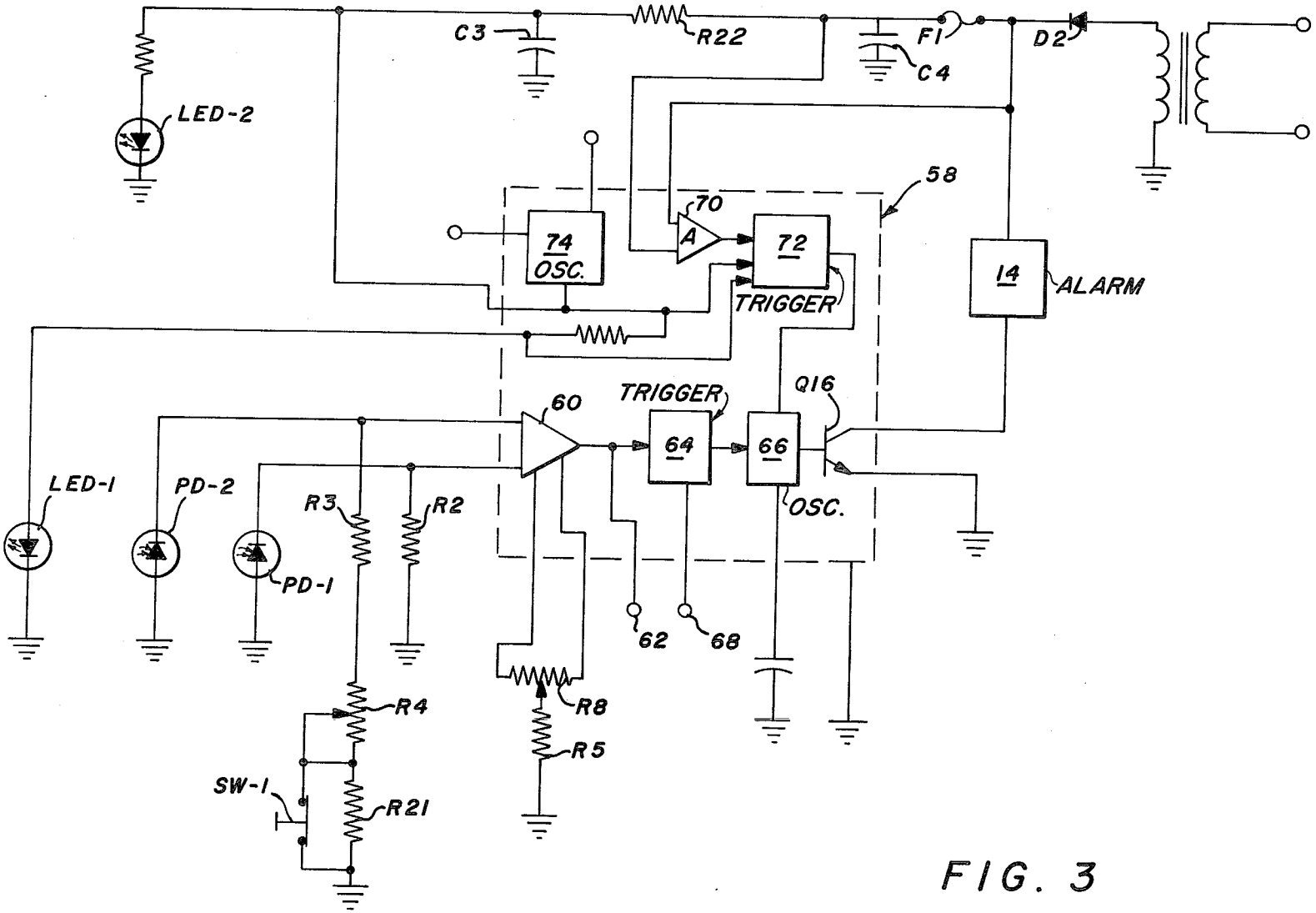
FIG. 3 is a functional block diagram of a third embodiment of the present invention which employs integrated circuitry and which is alternating current powered.

FIG. 3 is an integrated circuit version of the smoke detector of FIG. 1. The embodiment of FIG. 3 functions in the same manner as that of FIG. 1. In FIG. 3 the integrated circuit includes a high impedance differential amplifier 60 which is provided with an external balancing circuit including resistor R5 and potentiometer R8. A test point 62 is provided for checking the balance of the amplifier. The output of amplifier 60 is delivered to a Schmitt trigger circuit 64 which provides a small amount of hysterisis in the switching signal applied to an output oscillator 66. An optional delay pin 68 is provided if balancing for noise-false triggering is required in some installations.

The integrated circuit also includes an amplifier 70 which detects a blown fuse F. Amplifier 70 provides a first input signal to a second Schmitt trigger circuit 72. Schmitt trigger 72 is connected to detect a failure of LED-1. It is to be noted that Schmitt trigger 72 has the capability of detecting either an open or shorted LED.

Oscillator 66 is an audio oscillator which drives a horn or other audible warning device 14 via an output transistor Q16. In the FIG. 3 embodiment, unlike the embodiments of FIGS. 1 and 2, an AC horn is used as the audible warning device 14. A second oscillator 74 is not employed in the AC mode. A discussion of the operation of the circuit of FIG. 3 is believed unnecessary since, with the exception of the use of an AC horn rather than a DC energized audible alarm, the embodiments of FIGS. 1 and 3 are functionally identical.

Figure 4:
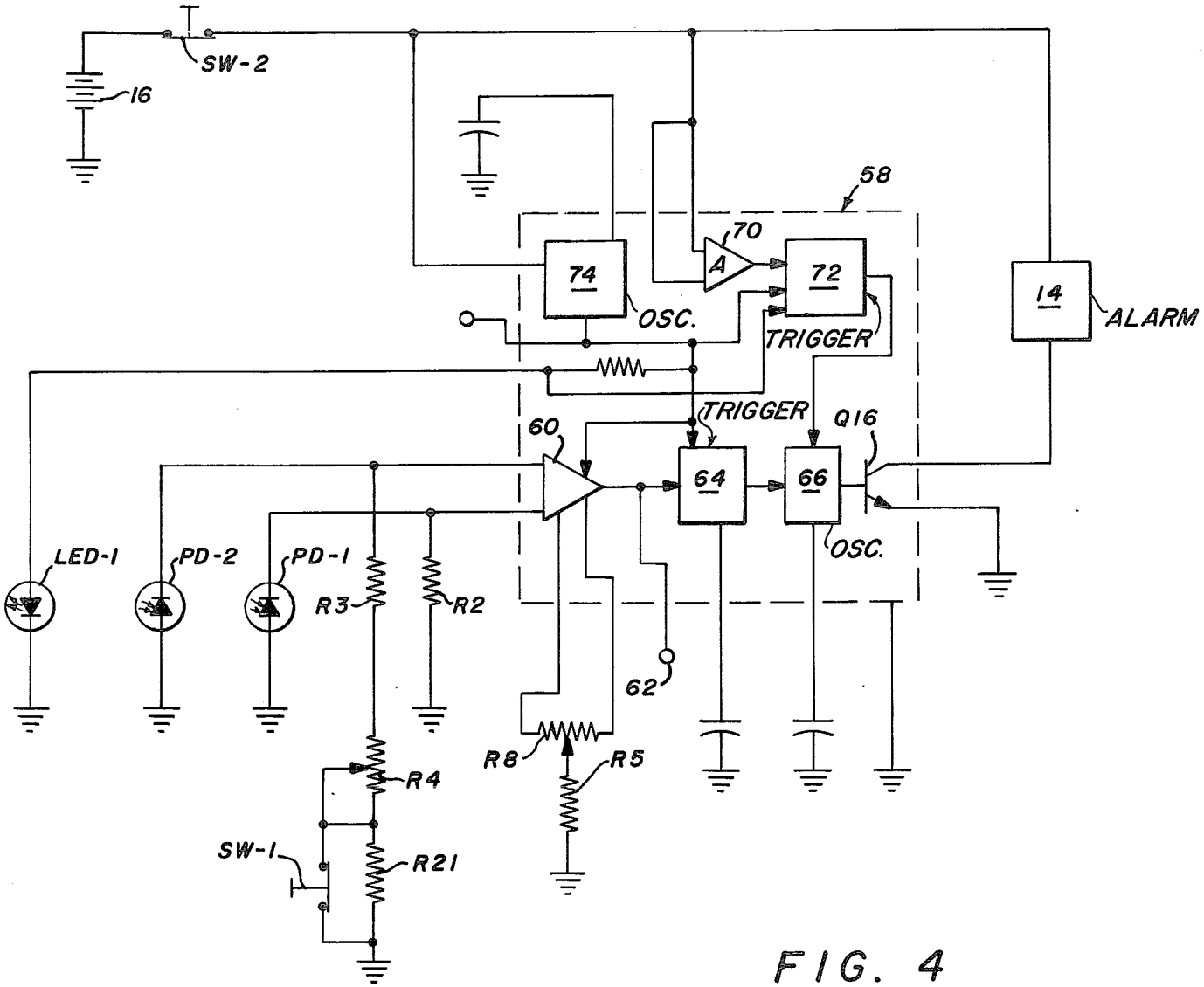
FIG. 4 is a functional block diagram of a fourth embodiment of the present invention which employs integrated circuitry and is direct current powered.

Referring to FIG. 4, an integrated circuit version of the embodiment of FIG. 2 is depicted. The embodiment of FIG. 4 is substantially identical to that of FIG. 3; i.e., the same integrated circuit as indicated generally at 58; may be employed in both the AC and DC powered integrated circuit versions of the smoke detector of the present invention. In the DC mode of operation, the oscillator 74 is used to strobe power to the detector 73 thereby minimizing power consumption and enhancing battery life.

Figure 5:
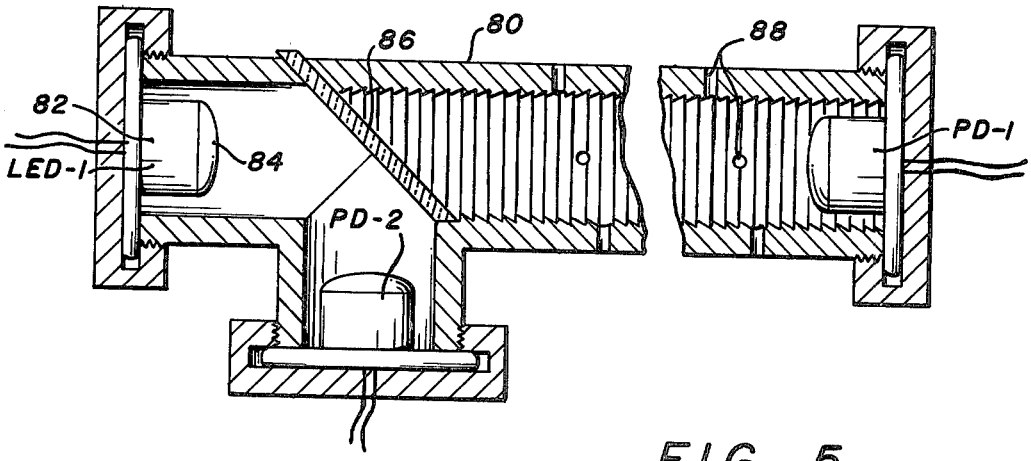
FIG. 5 is a cross-sectional view of a smoke chamber in accordance with one embodiment of the invention.

Referring now to FIG. 5, a preferred embodiment of a smoke chamber for use in all of the embodiments of FIGS. 1–4 is shown. The smoke chamber is characterized by dimensional rigidity wherein relative angular movement between LED-1 and photo detectors PD-1 and PD-2 is precluded. The smoke chamber is defined by a rigid tube 80 which will typically, but not necessarily, be comprised of metal. The internal surfaces of tube 80 are non-reflective. Reflectance within tube 80 is precluded by finishing the tube with black paint and possibly also by forming the tube with a ribbed internal surface configuration as shown in FIG. 5. It is important that the tube 80 not impart wave guide action to the light transmitted down the tube; i.e., performance of the smoke is optimized by permitting only light which is directly emitted by LED-1; i.e. light which follows a straight path; to be received by the photo detectors PD-1 and PD-2.

The light source; i.e., LED-1; is mounted at a first end of tube 80 as shown. In one reduction to practice LED-1 was mounted on a ceramic base and hermetically encapsulated in a metal can 82 with a glass lens 84. This arrangement eliminates distortion of the LED output during use and particularly minimizes the possibility of any significant variation in the output light pattern. In the reduction to practice being described, LED-1 comprised a Hewlett Packard type 680nmIRED LED. The photo diodes PD-1 and PD-2 are similarly mounted on ceramic bases in metal cans and are provided with glass lenses. This arrangement eliminates the possibility of distortion of the lenses with temperature and results in the photo diodes having an output which is linear from 0 to 400 mv. Encapsulation of the photo diodes and LED in metal cans permits the photo diodes and light emitting diode to be bonded, for example by soldering, into tube 80 whereby relative movement therebetween is precluded.

The reference photo diode, PD-2, is preferably positioned as closely as possible to the light source. This positioning is achieved through the use of a splitter plate 86 mounted within tube 80 at a 45° angle as shown. As noted, it is desirable to have both photo diodes exposed to substantially equal light intensity for tracking purposes. By judicious selection of the length of tube 80, so as to take into account the light losses along the length of the tube between LED-1 and PD-1, an untreated glass which reflects approximately 10% of the light emitted by LED-1 to reference diode PD-2 provides good results. In practice satisfactory results are achieved if the light impinging on PD-1 and PD-2 is of the same intensity ±10%. A crown quartz plate with a polished ground surface performs exceptionally well as splitter 86 since the light losses through the quartz are small and the material is essentially distortion free. The above-described arrangement results in both photo diodes looking at the light emitted by LED-1 head on and false triggering due to changing patterns (lobes) of LED-1 with temperature are thus avoided.

The tube 80 is preferably provided with a pattern of holes 88 on three sides and the holes are staggered so as to trap smoke within the tube. The holes are positioned so that they are displaced from the splitter plate 86 and photo detector PD-1 in the interest of preventing a loss in sensitivity resulting from a light leakage into tube 80 and also to minimize dust collection on the splitter plate and the lens of PD-1.

Figure 6:
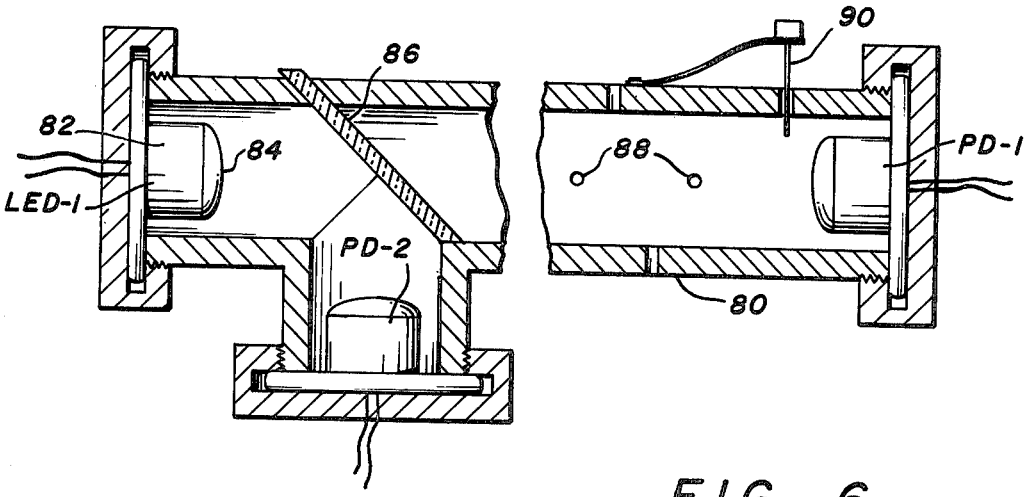
FIG. 6 is a cross-sectional view of a smoke chamber in accordance with another embodiment of the invention.

Referring to FIG. 6, a mechanical means for simulating the presence of smoke in tube 80 is depicted. A spring loaded "needle" 90 is located to the exterior of tube 80 and in alignment with a hole therein; needle 90 being positioned between splitter plate 86 and photo diode PD-1. In actual practice, needle 90 substantially fills the hole through which it may be extended into tube 80 to preclude leakage of light into the smoke chamber. In view of the high degree of sensitivity of the instrument, a very slight extension of the needle will cause a predetermined small obscuration of PD-1. Needle 90 is operated by means of a push button located to the exterior of the housing for the smoke detector.

While preferred embodiments have been shown and described, various modifications and substitutions may be made thereto without departing from the spirit and scope of the invention. Accordingly, it will be understood that the present invention has been described by way of illustration and not limitation.

What is claimed is:

1. An obscuration type smoke detector comprising:

means defining a smoke chamber, said chamber defining means being provided with a plurality of spaced apertures for admitting smoke thereto;

a light source mounted to said chamber defining means so as to emit light into the smoke chamber;

first light detector means mounted to said chamber defining means, said first light detector means including a first light detector positioned to directly receive light emitted by said light source and transmitted across the smoke chamber whereby the intensity of the light incident upon said first light detector will be a function of the density of the smoke in the chamber, said first light detector generating an electrical signal commensurate with the intensity of the light received thereby;

reference signal generating means, said reference signal generating means including a second light detector, said reference signal generating means being mounted to said chamber defining means and being positioned such that light emitted into the smoke chamber by said light source will be incident on said second light detector whereby said second detector will generate an electrical output signal;

comparator means, said comparator means being connected to receive as inputs the signals generated by said first light detector and said reference signal generating means, said comparator means providing an alarm energization signal when the difference between the input signals thereto are indicative of a predetermined smoke density; and means responsive to the alarm energization signal provided by said comparator means for providing an audible warning.

2. The apparatus of claims 1 wherein said first and second light detectors are photo diodes and wherein said first detector means and said reference signal generating means each comprise:

means connecting said photo diodes to operate in a photo voltaic mode.

3. The apparatus of claim 2 further comprising:

means positioned within said smoke chamber defining means for dividing the light emitted by said light source between said first detector means and said reference signal generating means.

4. The apparatus of claim 3 wherein said light source comprises:

a light emitting diode.

5. The apparatus of claim 4 wherein said light emitting diode and said photo diodes are each mounted within a housing and said housings are bonded to said smoke chamber defining means whereby relative movement between said diodes is precluded.

6. The apparatus of claim 5 wherein said smoke chamber defining means comprises:

a tubular member, said tubular member having a pair of oppositely disposed axially aligned open ends which respectively receive said light emitting diode and said first detector means photo diode, said tubular member further having an off-axis opening for receiving said reference generating signal means photo diode, the inside of said tubular member being characterized by minimal reflectance.

7. The apparatus of claim 6 wherein said dividing means is mounted in said tubular member so as to intersect said axis and in close proximity to said light emitting diode whereby the length of the light path between said light emitting diode and said reference signal generating means photo diode is minimized.

8. The apparatus of claim 7 wherein the length of said tubular member along said axis is selected such that said photo diodes are subjected to approximately equal light intensity in the absence of smoke in the chamber.

9. The apparatus of claim 8 wherein said dividing means comprises:

splitter plate means mounted in said tubular member so as to present a face to said light emitting diode which is angularly related to said axis, a predetermined portion of the light emitted into the smoke chamber being reflected from said angled face directly to said reference signal generating means photo diode and the remainder of said emitted light being transmitted through said splitter plate means.

10. The apparatus of claim 9 wherein said chamber defining means apertures comprise an array of holes in said tubular member, said holes being staggered on opposite sides of said member so as to entrap smoke in the chamber, said holes being in the portion of said member located between said splitter plate means and said first detector means photo diode.

11. The apparatus of claim 1 wherein said comparator means comprises:

a differential amplifier, said amplifier receiving the signals generated by said first and second light detectors, said amplifier generating an offset voltage when the light intensity at said first detector is diminished by the presence of smoke in the chamber;

means for equalizing the voltages across said light detectors whereby the offset voltage may be nulled in the absence of smoke;

high gain voltage comparator means, said high gain comparator means receiving said offset voltage and generating said alarm energization signal in response to an offset voltage in excess of a predetermined minimum, said comparator means including a feedback circuit which determines said minimum.

12. The apparatus of claim 11 further comprising:

means for electronically simulating the presence of smoke, said simulating means including means for unbalancing the voltage across said detectors.

13. The apparatus of claim 11 further comprising:

means responsive to the operative state of said light source for periodically energizing the audible alarm upon a failure of said light source.

14. The apparatus of claim 11 further comprising:

means for sensing a component failure and generating a signal commensurate therewith; and means responsive to said signal commensurate with a component failure for energizing the audible alarm.

15. The apparatus of claim 11 further comprising:

means for sensing the voltage applied to said comparator means, said sensing means generating an alarm energization signal when said applied voltage falls below a predetermined level.

* * * * *